US005956547A

United States Patent [19]

Kamei et al.

[11] Patent Number: 5,956,547

[45] Date of Patent: Sep. 21, 1999

[54] IMAGE FORMING DEVICE EQUIPPED WITH FIXING DEVICE

[75] Inventors: Yukikazu Kamei, Ichihara; Kiyoshi Toizumi, Yamatokooriyama; Hideki Ohnishi, Chiba, all of Japan

[73] Assignee: Sharp Kabushiki Kaisha, Osaka, Japan

[21] Appl. No.: 09/119,862

[22] Filed: Jul. 21, 1998

[30] Foreign Application Priority Data

Aug. 18, 1997 [JP] Japan ..... 9-221413

[51] Int. Cl.[6] ..... G03G 15/20

[52] U.S. Cl. ..... 399/122; 399/328

[58] Field of Search ..... 399/122, 321, 399/328–332, 320; 219/216

[56] References Cited

U.S. PATENT DOCUMENTS

| | | | |
|---|---|---|---|
| 4,782,359 | 11/1988 | Tomoe . | |
| 4,791,448 | 12/1988 | Kawashima et al. . | |
| 4,965,640 | 10/1990 | Watarai et al. . | |
| 5,045,887 | 9/1991 | Nakamura . | |
| 5,049,945 | 9/1991 | Fukano et al. . | |
| 5,291,256 | 3/1994 | Kitajima et al. . | |
| 5,802,426 | 9/1998 | Miyazaki et al. | 399/113 |

FOREIGN PATENT DOCUMENTS 5289564 11/1993 Japan .

*Primary Examiner*—Richard Moses

*Attorney, Agent, or Firm*—Dike, Bronstein, Roberts & Cushman, LLP; David G. Conlin

[57] ABSTRACT

Enabling to perform the pressurization release and the fixture release simultaneously by one action when taking out the fixing device from the image forming device for removing the jammed paper and the like. In a fixing device comprising a pressurization roll being pressurized by the act of a pressurization lever and a spring against a heat roll, a release lever is further mounted rotatably which comprises a cam for rotating the pressurization lever against the direction of force from the spring. On the release lever is mounted a connecting pin, and the connecting pin is linked to and rotates the fixing lever which is also mounted rotatably. The fixing lever is forced toward the fixing direction by a spring, wherein a fixing piece is inserted to a fixing slit of a mounting stage formed on the image forming device body for positioning thereto. By rotating the release lever, the pressurization lever could be rotated to the direction for releasing the pressure, and simultaneously, the fixing lever is linked thereto and rotated to the direction for releasing the fixing piece from the fixing slit, thereby performing the pressurization release and fixture release by a single operation.

5 Claims, 6 Drawing Sheets

IMAGE FORMING DEVICE EQUIPPED WITH FIXING DEVICE

BACKGROUND OF THE INVENTION

The present invention relates to an image forming device comprising a fixing device for heat-fixing a formed unfixed image of a toner image and the like, in a copying machine, laser beam printer and the like using an electrophotograph method.

The image forming device utilizing an electrophotograph method creates a manifest image by powder toner from a latent image formed on a photosensitive body having a photosensitive layer which works as a recording medium, and transfers said manifested toner image onto a sheet-type paper which is the image holding body, and since said toner is unfixed, heat is applied to melt the toner, and then pressure is added thereto to fix said toner image onto the paper. In order to do so, a fixing device is provided on the lower stream side of a paper conveyance passage which passes through an image forming region, for example, just before a discharge portion of the paper.

As one example of such fixing device, a fixing device is formed of a heat roll having in the interior thereof a heater lamp comprising a halogen lamp as the heating source, and a pressurization roll pressurized to said heat roll by a predetermined pressurization force.

The fixing device is positioned in front of a discharge portion opening to the exterior of the conveyance passage which passes through an image forming portion, wherein a toner image on a sheet-type paper formed at the image forming portion is contacted to the heat roll, and by the heat of the heat roll and the pressurization force provided in co-operation with the pressurization roll, the toner image is heat-fixed to the sheet.

The heat roll comprised in the fixing device is equipped with the heater lamp positioned inside a cylinder having a pipe of aluminum (Al) as a cored bar, the cylinder surface being covered by a silicon rubber member and the like having a good releasing character against the toner and the like. The silicon rubber covering layer and the cored bar are adhered and fixed together by an adhesive called a primer, thereby forming the heater roll.

The surface of the heat roll is maintained at a fixable temperature, in order to heat-fix said toner to the sheet of paper. Therefore, a heat detection sensor such as a thermistor is mounted so as to contact the surface of the heat roll, and in response to the heat detection signal from the sensor, the driving control of the power supply for the heater lamp is operated, and the heat roll surface temperature is maintained at a set temperature enabling fixing operation.

Further, the pressurization roll is forced toward the heat roll by a pressurization lever so as to press the paper to the heat roll direction. The pressurization lever is axially supported on one end, and the other end is forced by a spring so as to pressurize the roll toward the heat roll.

If the toner image is not single colored, but rather a colored image where a plurality of colors are superposed, then toner may easily be adhered to the heat roll, causing an offset where the adhered toner is transferred to the next sheet of paper. Therefore, in order to remove the toner adhered to the heat roll, a cleaning means is provided. The cleaning means either presses a cleaning pad, or a cleaning web, onto the roll surface, so as to wipe off the adhered toner on the heat roll.

Moreover, in order to prevent toner from adhering to the heat roll surface, an application device for applying to the heat roll surface an oil having good releasing ability against toner, such as silicon oil, is further equipped. The application device comprises an application roll for applying oil to the heat roll surface, an oil tank for storing the oil of an offset preventing liquid, a supply felt for supplying the oil in the oil tank to the application roll surface, and a blade for uniforming the oil supplied to the application roll.

The felt for supplying oil is submerged at one end to the oil inside the oil tank, and the other end of the felt is pressurized by a forcing means of spring and the like so as to contact the application roll. The oil supplied to the rotating application roll is flattened uniformly by the blade, and by rotating with contact to the heat roll, a uniform oil layer could be applied to the heat roll surface.

The fixing device having the above mentioned structure is formed as a unit and mounted removably to the image forming device body. Therefore, each of the above-mentioned members are stored inside a casing so as to form one unit. On the casing is formed an opening for introducing the paper to the pressurizing portion between the heat roll and the pressurization roll, and a discharge exit for discharging the fixed paper.

Further, in correspondence to the opening, a guide for guiding the paper to rollers, and a positioning hole for positioning the unit of the fixing device to the predetermined position in the image forming device body are formed to the casing.

On the mounting stage for fixing the fixing device to the predetermined position on the image forming device body is formed a positioning pin for insertion to the positioning hole. The casing forming the fixing device unit is further equipped with a fixed piece for fixing the fixing device to the mounting stage, and a fixing piece formed on the mounting stage. The two pieces are fixed by a fixing screw.

In the fixing device formed as one unit, when the paper is jammed at that position, a part of the image forming device is opened, and the fixing state between the mounting stage is released, or in other words, the fixing screw is removed, and the fixing device is taken out by the whole unit. Thereafter, the pressurized state of the heat roll and the pressurization roll is released. The release structure works so as to remove the pressure by rotating the pressurization lever against the force of the spring. Thereby, the jammed paper could be removed easily.

According to the fixing device formed as a unit, it is mounted removably to the image forming device body so as to simplify the jam management and the like, thereby considering easy maintenance for the user. Moreover, the fixing device has a shorter life than the fixing device body, and the general removable structure enables easy replacement. In other words, in order to improve the serviceability and the operability (operational characters), the fixing device is mounted removably to the image forming device body.

In the conventional jam management, when jam was sensed, the action of the fixing device was also stopped in response, and the jammed paper was removed by pulling out the paper in the conveyance direction. Such operation fixes the toner image utilizing the remaining heat of the heat roll, thereby preventing the contamination of the image forming device interior or the user by the unfixed toner. In this case, when the jammed paper could not be pulled out, as was explained above, the pressurization force on the pressurization roll is released.

As was disclosed above, the conventional fixing device was considered to pull out the jammed paper to the paper conveyance direction in order to solve the fouling caused by the unfixed toner, thereby improving the serviceability and the operability of the jam management. In other words, the unfixed toner image is fixed to the paper by the remaining heat of the heat roll in the fixing device.

However, in the fixing device, the providing of electricity to the heater lamp in the heat roll is also released when the jam has occurred, so therefore, the fixing of the unfixed toner may not always be performed completely merely by the use of remaining heat of the heat roll. Moreover, when the toner image is a colored one, the fixing performance may be very unfavorable, and the paper may be pulled out in a unfixed state, causing fouling by the toner.

Since sufficient fixing is not performed, a cold offset may occur where the toner adheres to the heat roll. Therefore, the load of the cleaning means for removing the toner is increased, causing cleaning disorder. Then, an offset may occur where the toner is transferred to the paper after the jam management.

Moreover, if the pressure of the pressurization roll is released when pulling out the jammed paper, because sufficient pressurization status will not be maintained, and fixing disorder of the unfixed toner image may occur, making remarkably the above mentioned problems. Even further, the unfixed toner may be dispersed when pulling out the paper, fouling not only the fixing device but also the user or other components. In this case, when the toner contaminates the application felt preventing offset, it may cause an uneven application of oil, and stable fixing could no longer be performed.

In order to completely remove the toner adhered to the heat roll, a web method-type cleaning means is effective. However, this method causes complication of the structure, increasing the size of the fixing device and the cost. Further disadvantage of the method is the occurrence of oil lines on an OHP sheet.

Therefore, by taking the fixing device out of the image forming device body when removing the jammed sheet, the unfixed toner will not foul the interior of the image forming device. However, in order to remove the fixing device, the fixing screw working as the fixing means must be removed, and further, the pressure on the pressurization roll must be released. The operation may become complex, and when the user forgets to release the pressure, the removal of the jammed paper may be difficult, or unfixed toner may be dispersed by the removing operation, fouling the user.

SUMMARY OF THE INVENTION

The object of the present invention is to solve the above mentioned problems by providing a device where the fixing device could be removed easily from the image forming device body for easy jam management, and at the same time enabling jam removal process without causing toner fouling.

In order to achieve the above-mentioned objects, the image forming device of the present invention comprises a fixing device positioned in a conveyance passage of an image holding body holding an unfixed image; said fixing device comprising a heat roll whose surface is heated to a desired temperature for heat-fixing said unfixed image; and a pressurization roll for contacting said image holding body pressurized and conveyed by said heat roll to the heat roll side; wherein a fixing member for fixing said fixing device to a predetermined position in said conveyance passage is provided, and the fixture release by said fixing member is performed in linkage to the operation for the pressurization release between said heat roll and said pressurization roll.

In other words, when removing the fixing device from the image forming device, the fixed state of the fixing device is released with linkage to the operation to release the pressurized state. Therefore, the fixture of the fixing device could be released by one operation, and it could be taken out easily from the image forming device. Therefore, the jammed paper could be removed from the fixing device easily, increasing the serviceability and the operability greatly.

As an example of the above mentioned structure, as shown in FIGS. 2A and 2B, the pressurization release is equipped with a rotating release lever (53), the release lever (53) equipped with a member such as a cam **(53*a*) for rotating a pressurization lever (50) pressurizing the pressurization roll (42) to the heat roll (41) side in opposition to the force of a spring (52) forcing the pressurization lever to the heat roll (41) side, further equipped with a connecting member (53*b*, 54*b*) for rotating a fixing lever (54) forced continuously toward the fixing direction so as to fix the fixing device to a mounting stage (fixed position 57) to the fix release direction. By the release operation of the release lever (53) to the direction of arrow, simultaneously with the pressurization release, a fixing piece (54*c*) of the fixing lever (54) is dislocated from a fixing slit (57*b*)** on the mounting stage, and the fixed state is simultaneously released. Therefore, simultaneously as the pressurization release of the pressurization roll against the heat roll, the fixed state of the fixing device could be released by only one operation. The structure realizing such effect could be performed by a simple structure merely adding a fixing lever, thereby simplifying the removal operation of jammed paper.

Further, the image forming device comprising a fixing device for achieving the object of the present invention of simplifying the removal operation of the jammed paper without causing dispersion of toner regards to an image forming device equipped with a fixing device having a heat roll whose surface is heated to a desired temperature so as to heat-fix an unfixed image and a pressurization roll for contacting an image holding body pressurized and conveyed by said heat roll to the heat roll side, the fixing device being positioned in a conveyance passage of the image holding body holding said unfixed image, wherein a fixing member for fixing said fixing device to a predetermined position in said conveyance passage is provided, and by performing a fixture release by said fixing member, said fixing device is mounted to said predetermined position enabling removal therefrom, and further comprising a limiting means for disabling the pulling out of said image holding body to the same direction as the conveyance direction of said image holding body, but rather, enabling the pulling out of said image holding body to the opposite direction after said fixing device is removed.

In such structure, by releasing the fixed state of the fixing device and taking it out of the image forming device, the jammed paper could be removed. In this case, the jammed paper could not be removed by pulling out to the paper conveyance direction, but rather, could be removed easily by pulling it out in the opposite direction. Therefore, the unfixed toner would not contact the heat roll, but instead, only the toner which has already been fixed will contact the heat roll, which leads to easy removal of paper by causing no spread of toner due to fixing disorder.

The limiting means for disabling the pulling out of the image holding body to the conveyance direction and enabling the pulling out in the opposite direction could be formed by a one-way clutch which enables transmission of drive force to the heat roll or the pressurization roll in the conveyance direction of the image holding body, and freeing the drive to the other direction. The object could be achieved easily without the need to mount a special structure.

Further, regarding the structure of the image forming device comprising the above mentioned fixing device, in the fixture released state of the fixing device, when removing the fixing device, the image holding body could be held between the two rolls, and released of its pressure at a state where the image holding body could be removed simultaneously. Then, there will be no fear of the jammed paper being dropped inside the image forming device, and there is no chance of the image forming device interior being fouled by the dispersed toner.

PREFERRED EMBODIMENT OF THE INVENTION

Figure 1:
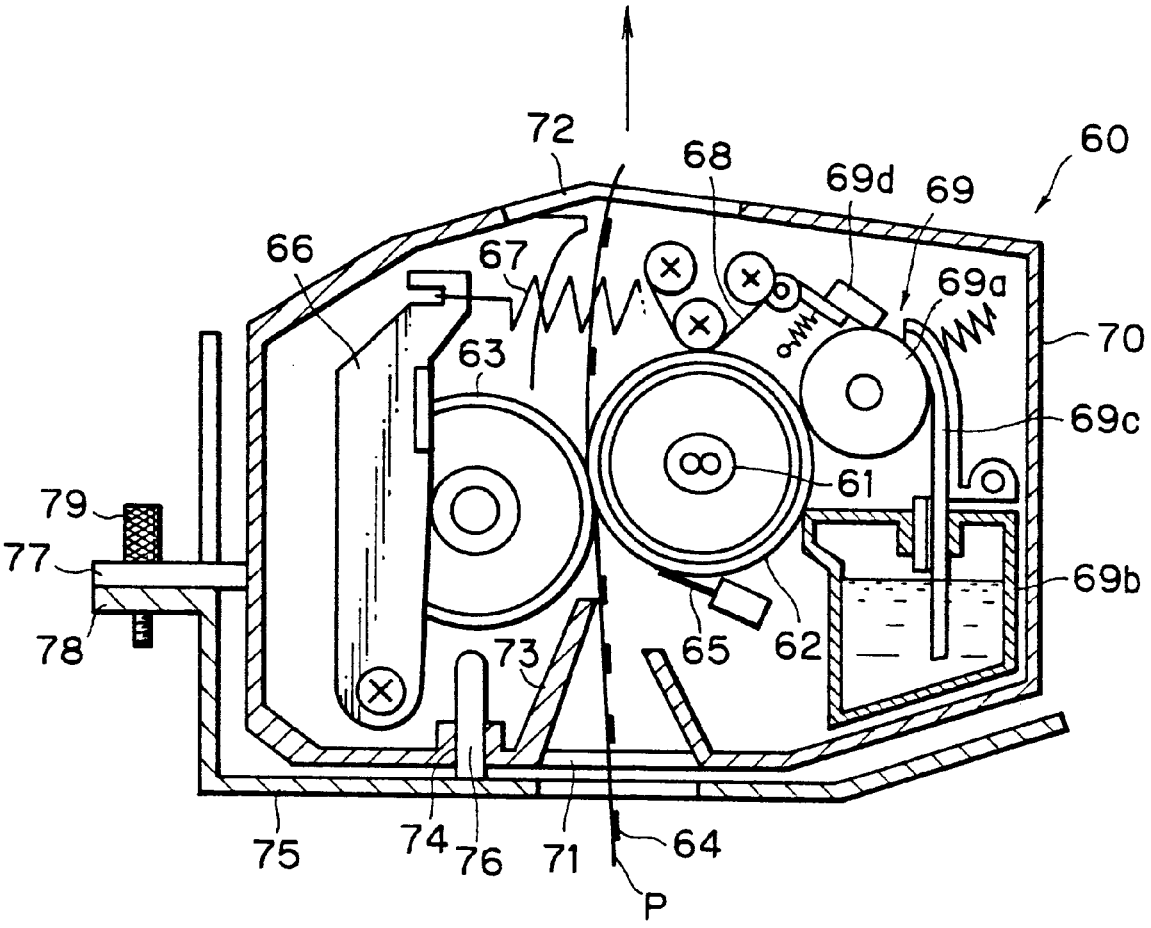
FIG.1 ( PRIOR ART )
FIG. 1 is a drawing showing the structure of the prior art fixing device.

As one example of conventional fixing device, as is shown in FIG. 1, a fixing device 60 is formed of a heat roll 62 having in the interior thereof a heater lamp 61 comprising a halogen lamp as the heating source, and a pressurization roll 63 pressurized to said heat roll 62 by a predetermined pressurization force.

The fixing device 60 shown in FIG. 1 is positioned in front of a discharge portion opening to the exterior of the conveyance passage which passes through an image forming portion, wherein a toner image 64 on a sheet-type paper P formed at the image forming portion is contacted to the heat roll 62, and by the heat of the heat roll 62 and the pressurization force provided in co-operation with the pressurization roll 63, the toner image is heat-fixed to the sheet.

The heat roll 62 comprised in the fixing device 60 is equipped with the heater lamp 61 positioned inside a cylinder having a pipe of aluminum (Al) as a cored bar, the cylinder surface being covered by a silicon rubber member and the like having a good releasing character against the toner and the like. The silicon rubber covering layer and the cored bar are adhered and fixed together by an adhesive called a primer, thereby forming the heater roll 62.

The surface of the heat roll 62 is maintained at a fixable temperature, in order to heat-fix said toner to the sheet of paper P. Therefore, a heat detection sensor 65 such as a thermistor is mounted so as to contact the surface of the heat roll 62, and in response to the heat detection signal from the sensor 65, the driving control of the power supply for the heater lamp 61 is operated, and the heat roll 62 surface temperature is maintained at a set temperature enabling fixing operation.

Further, the pressurization roll 63 is forced toward the heat roll 62 by a pressurization lever 66 so as to press the paper P to the heat roll 62 direction. The pressurization lever 66 is axially supported on one end, and the other end is forced by a spring 67 so as to pressurize the roll 63 toward the heat roll 62.

If the toner image 64 is not single colored, but rather a colored image where a plurality of colors are superposed, then toner may easily be adhered to the heat roll 62, causing an offset where the adhered toner is transferred to the next sheet of paper P. Therefore, in order to remove the toner adhered to the heat roll 62, a cleaning means 68 is provided. The cleaning means 68 either presses a cleaning pad, or a cleaning web as shown in the drawing, onto the roll surface, so as to wipe off the adhered toner on the heat roll 62.

Moreover, in order to prevent toner from adhering to the heat roll 62 surface, an application device 69 for applying to the heat roll 62 surface an oil having good releasing ability against toner, such as silicon oil, is further equipped. The application device 69 comprises an application roll 69*a* for applying oil to the heat roll 62 surface, an oil tank 69*b* for storing the oil of an offset preventing liquid, a supply felt 69*c* for supplying the oil in the oil tank 69*b* to the application roll 69*a* surface, and a blade 69*d* for uniforming the oil supplied to the application roll 69*a*.

The felt 69*c* for supplying oil is submerged at one end to the oil inside the oil tank 69*b*, and the other end of the felt 69*c* is pressurized by a forcing means of spring and the like so as to contact the application roll 69*a*. The oil supplied to the rotating application roll 69*a* is flattened uniformly by the blade 69*d*, and by rotating with contact to the heat roll 62, a uniform oil layer could be applied to the heat roll 62 surface.

The fixing device 60 having the above mentioned structure is formed as a unit and mounted removably to the image forming device body. Therefore, each of the above-mentioned members are stored inside a casing 70 so as to form one unit. On the casing 70 is formed an opening 71 for introducing the paper P to the pressurizing portion between the heat roll 62 and the pressurization roll 63, and a discharge exit 72 for discharging the fixed paper P.

Further, in correspondence to the opening 71, a guide 73 for guiding the paper P to rollers 62 and 63, and a positioning hole 74 for positioning the unit of the fixing device 60 to the predetermined position in the image forming device body are formed to the casing.

On the mounting stage 75 for fixing the fixing device 60 to the predetermined position on the image forming device body is formed a positioning pin 76 for insertion to the positioning hole 74. The casing 70 forming the fixing device 60 unit is further equipped with a fixed piece 77 for fixing the fixing device 60 to the mounting stage 75, and a fixing piece 78 formed on the mounting stage 65. The two pieces are fixed by a fixing screw 79.

In the fixing device 70 formed as one unit, when the paper P is jammed at that position, a part of the image forming device is opened, and the fixing state between the mounting stage 75 is released, or in other words, the fixing screw 79 is removed, and the fixing device 60 is taken out by the whole unit. Thereafter, the pressurized state of the heat roll 62 and the pressurization roll 63 is released. The release structure works so as to remove the pressure by rotating the pressurization lever 66 against the force of the spring 67. Thereby, the jammed paper P could be removed easily.

According to the fixing device 60 formed as a unit, it is mounted removably to the image forming device body so as to simplify the jam management and the like, thereby considering easy maintenance for the user. Moreover, the fixing device 60 has a shorter life than the fixing device body, and the general removable structure enables easy replacement. In other words, in order to improve the serviceability and the operability (operational characters), the fixing device 60 is mounted removably to the image forming device body.

In the conventional jam management, when jam was sensed, the action of the fixing device 60 was also stopped in response, and the jammed paper was removed by pulling out the paper in the conveyance direction. Such operation fixes the toner image utilizing the remaining heat of the heat roll 62, thereby preventing the contamination of the image forming device interior or the user by the unfixed toner. In this case, when the jammed paper could not be pulled out, as was explained above, the pressurization force on the pressurization roll 63 is released.

As was disclosed above, the conventional fixing device was considered to pull out the jammed paper to the paper conveyance direction in order to solve the fouling caused by the unfixed toner, thereby improving the serviceability and the operability of the jam management. In other words, the unfixed toner image is fixed to the paper by the remaining heat of the heat roll 62 in the fixing device.

However, in the fixing device 60, the providing of electricity to the heater lamp 61 in the heat roll 62 is also released when the jam has occurred, so therefore, the fixing of the unfixed toner may not always be performed completely merely by the use of remaining heat of the heat roll 62. Moreover, when the toner image is a colored one, the fixing performance may be very unfavorable, and the paper may be pulled out in a unfixed state, causing fouling by the toner.

Since sufficient fixing is not performed, a cold offset may occur where the toner adheres to the heat roll 62. Therefore, the load of the cleaning means for removing the toner is increased, causing cleaning disorder. Then, an offset may occur where the toner is transferred to the paper after the jam management.

Moreover, if the pressure of the pressurization roll 73 is released when pulling out the jammed paper, because sufficient pressurization status will not be maintained, and fixing disorder of the unfixed toner image may occur, making remarkably the above mentioned problems. Even further, the unfixed toner may be dispersed when pulling out the paper, fouling not only the fixing device 60 but also the user or other components. In this case, when the toner contaminates the application felt 69*c* preventing offset, it may cause an uneven application of oil, and stable fixing could no longer be performed.

In order to completely remove the toner adhered to the heat roll 62, a web method-type cleaning means 68 is effective. However, this method causes complication of the structure, increasing the size of the fixing device 70 and the cost. Further disadvantage of the method is the occurrence of oil lines on an OHP sheet.

Therefore, by taking the fixing device 60 out of the image forming device body when removing the jammed sheet, the unfixed toner will not foul the interior of the image forming device. However, in order to remove the fixing device, the fixing screw 79 working as the fixing means must be removed, and further, the pressure on the pressurization roll 63 must be released. The operation may become complex, and when the user forgets to release the pressure, the removal of the jammed paper P may be difficult, or unfixed toner may be dispersed by the removing operation, fouling the user.

Figure 2A:
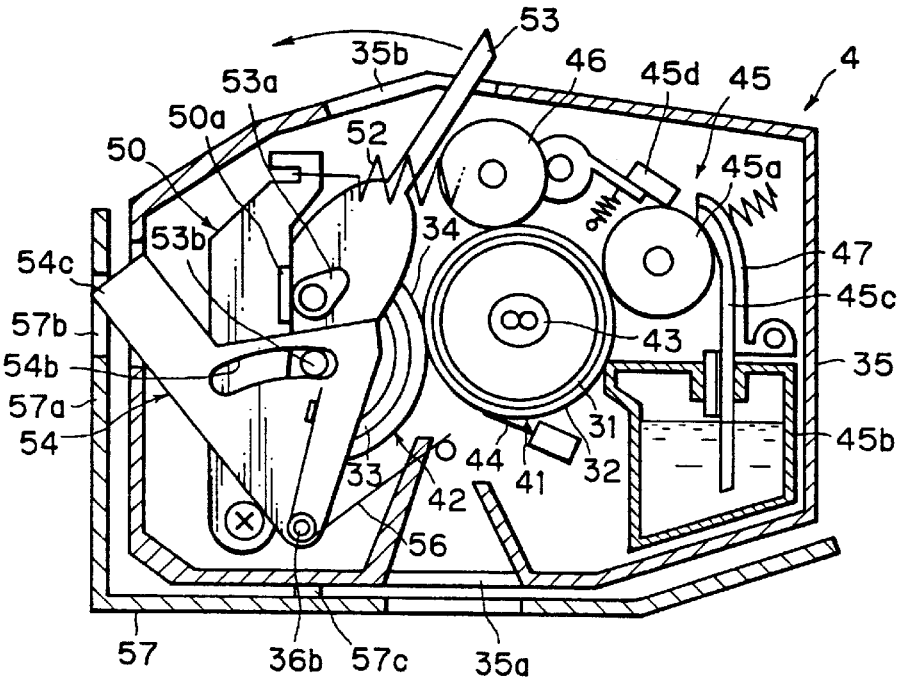
FIG. 2A is a drawing showing the first embodiment for performing the pressurization release and fixture release of the fixing device according to the present invention, and shows the state where the fixing device is fixed to the image forming device.
Figure 2B:
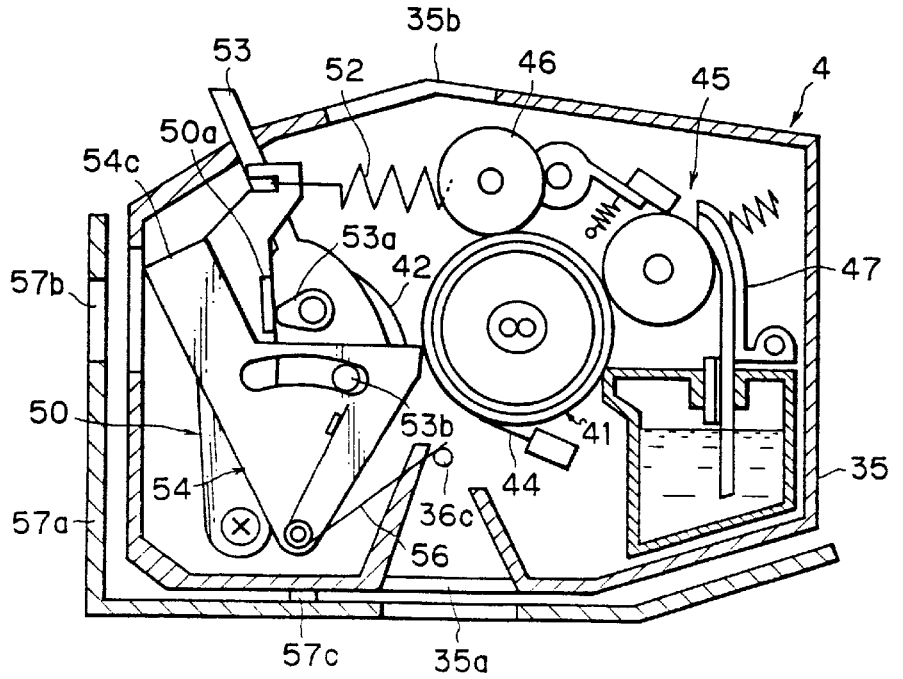
FIG. 2B is a drawing showing the first embodiment for performing the pressurization release and fixture release of the fixing device according to the present invention, and shows the state where the fixed state of the fixing device against the image forming device is released.
Figure 3:
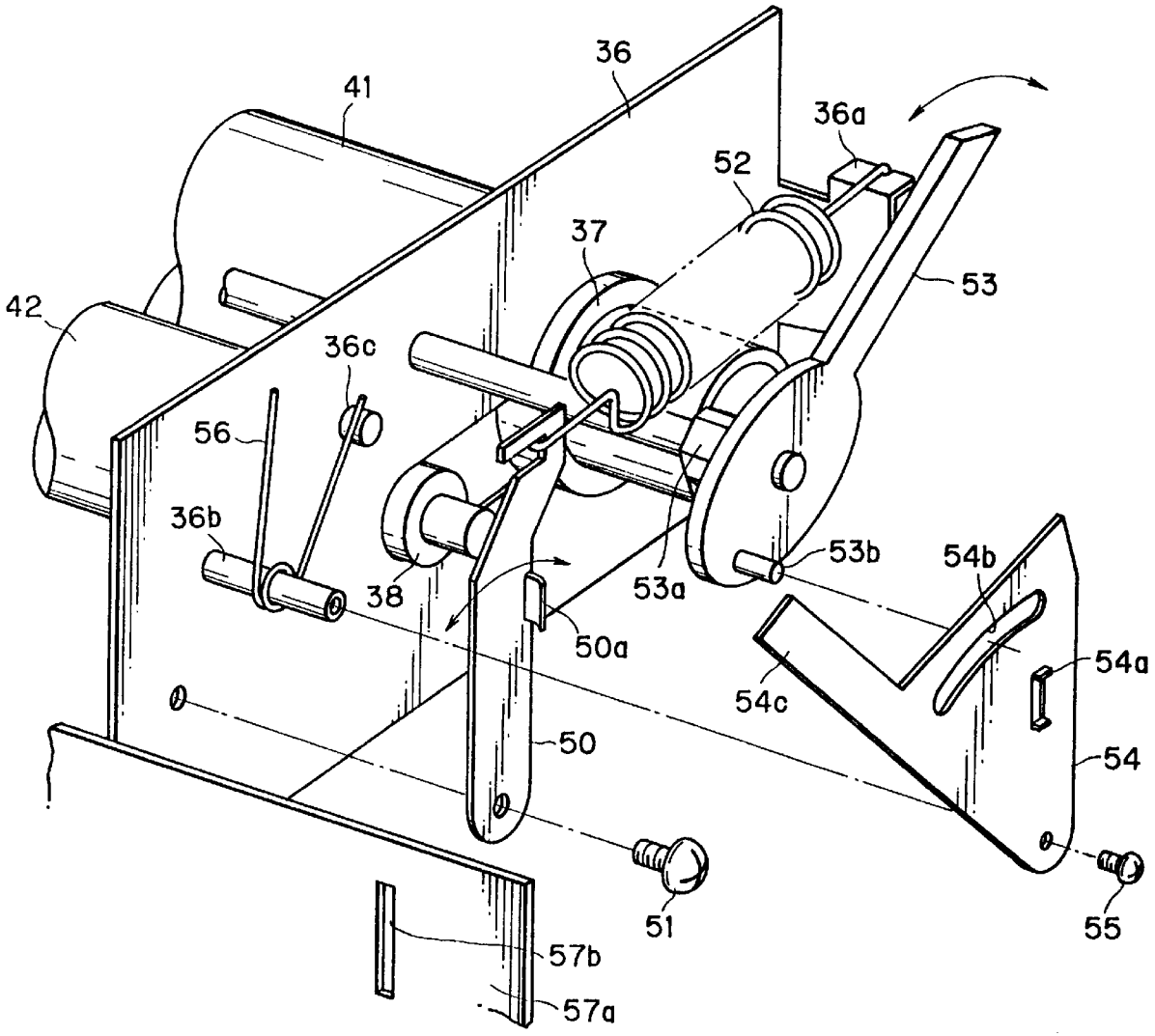
FIG. 3 is a schematic view showing one example of the structure for releasing the pressure and fixture of the fixing device shown in FIGS. 2A and 2B.

The embodiment of the present invention will be explained hereinafter in detail with reference to the accompanied drawings. Especially, FIGS. 2A and 2B is a partial cross-sectional side view showing the fixed state and the fixture released state of the fixing device to the image forming device body for explaining the first embodiment of the present invention, wherein FIG. 2A shows the fixed state, and FIG. 2B shows the fixture released state. FIG. 3 is a schematic view showing the detailed structure for fixing or releasing the fixing device shown in FIGS. 2A and 2B, and FIG. 4 is a view showing the whole structure of the image forming device comprising the fixing device of FIGS. 2A and 2B.

First, with reference to FIG. 4, the whole structure of the image forming device comprising the fixing device of the present invention will be explained.

Figure 4:
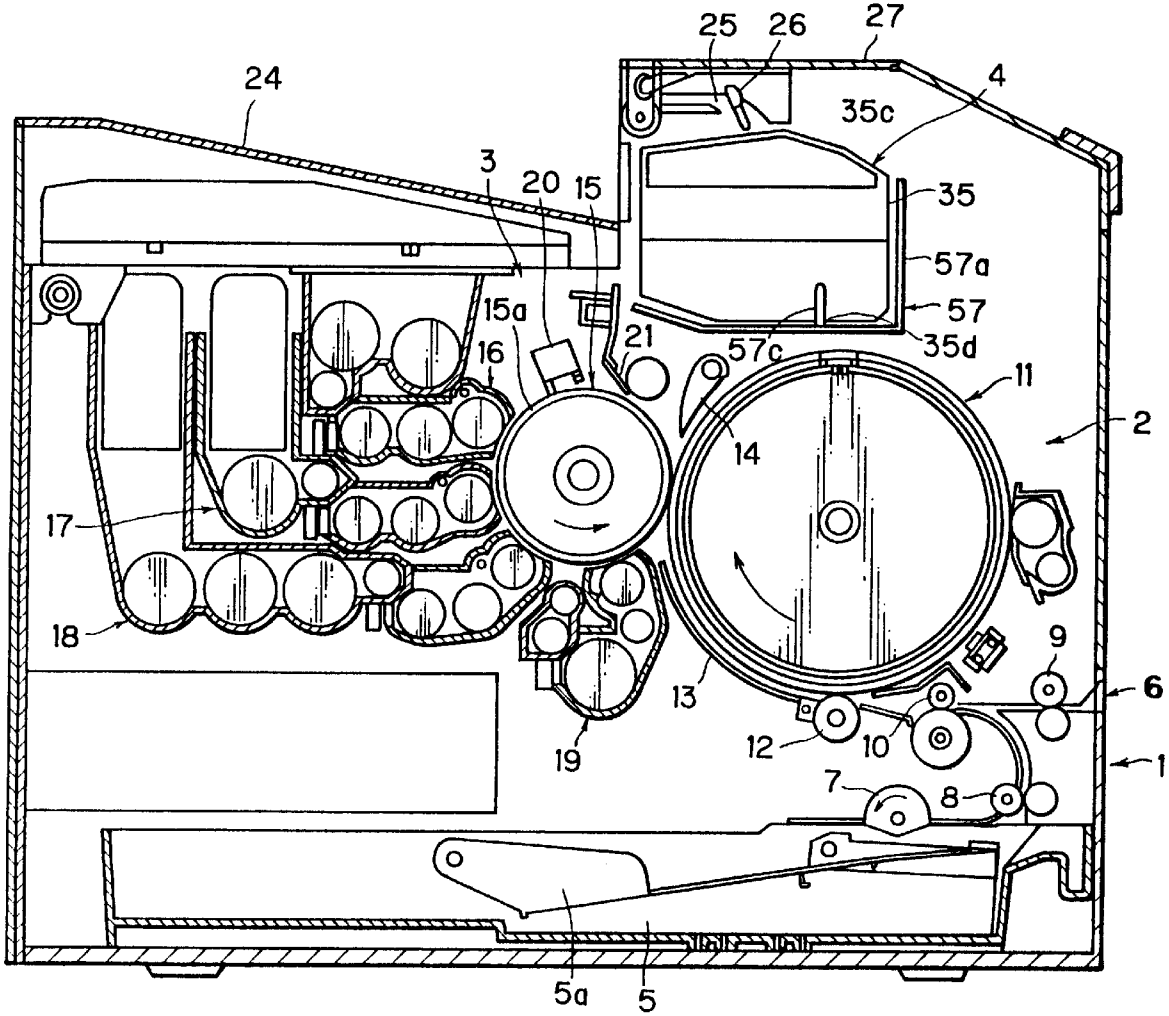
FIG. 4 is a drawing showing the whole structure of the image forming device comprising the fixing device of FIGS. 2A and 2B.

The image forming device shown in FIG. 4 is composed of a paper feed portion 1 for storing and supplying the sheet of paper which works as a recording paper where the toner image will finally be formed, a transfer portion 2 for transferring a toner image to the sheet of paper, an image forming portion 3 comprising a developing device and the like for forming the toner image, and a fixing device 4 according to the present invention for melting and fixing the toner image transferred to the sheet.

On the paper feed portion 1 is mounted a paper feed cassette 5 for storing the sheets of paper and positioned removably on the lowest area of the image forming device body, especially enabled to be pulled out from the front side or the right side (the front side of the device) in the drawing, and a manual feed inserting portion 6 for inserting the sheets of paper manually positioned on the front side of the device body, or the right side of the drawing. Further, a pickup roll 7 for sending out one paper at a time from the top portion of the sheets of paper being stored inside the paper feed cassette 5, a PF roll 8 for conveying the sheet paper sent out by said pickup roll, and a manual feed roll 9 for conveying the sheet of paper inserted from the manual feed inserting portion 6. Even further, a pre-curl roll 10 for curling in advance the paper being conveyed from said PF roll 8 and said manual feed roll 9 is mounted thereto. These units form said paper feed portion 1. The paper is sent out from said paper feed portion 1 to the transfer portion 2 according to image forming orders.

On said paper feed cassette 5 is mounted a push-up member or sheet mounting table 5*a* forced toward the upper direction in the drawing by a spring and the like, and on this sheet mounting table 5*a* is mounted the sheets of paper. Thereby, the paper stored inside said paper feed cassette 5 is positioned so that the top paper thereof is opposed to the pickup roll 7, and by one driving rotation of the pickup roll 7 toward the direction of the arrow, the roll contacts the top sheet, and one paper will be sent out. The sent out paper is conveyed to the pre-curl roll 10 by way of the PF roll 8.

Further, the sheet of paper being inserted from the manual feed inserting portion 6 will be conveyed to the pre-curl roll 10 through the manual feed roll 9.

Said pre-curl roll 10 curls the paper in advance being conveyed as explained above, which makes the paper to be easily adsorbed and held at the surface of a cylindrical transfer drum 11 equipped at the transfer portion 2.

The cylindrical transfer drum 11 mentioned above is equipped to said transfer portion 2 as transfer means. On the peripheral area of said transfer drum 11, members such as a ground roll 12 as a grounded electrode member, a guide member 13 for guiding the sheet so as not to fall from said transfer drum 11, a removing pawl 14 for removing the sheet adsorbed to said transfer drum 11, and the like are positioned. Said removing pawl 14 is mounted movably so as to either contact to or separate from the surface of said transfer drum 11, which removes the sheet from the transfer drum 11 after the transfer has finished.

Further, in the image forming portion 3, a photosensitive drum 15 pressing against said transfer drum 11 is mounted as the image holding body. This photosensitive drum 15 is formed of a conductive aluminum pipe 15*a* being grounded, and an OPC film (organic optical conductive film) 15*b*, for example, is applied to the surface thereof.

On the peripheral area of said photosensitive drum 15, developers 16, 17, 18 and 19 each storing a toner of yellow, magenta, cyan, and black are positioned radially in order, and moreover, an electrifier 20 for electrifying the surface of said photosensitive drum 15, a cleaning blade 21 for sweeping off and removing the remainder toner on the surface of the photosensitive drum 15, and so on are positioned. In the image forming portion 3, a toner image is formed on said photosensitive drum 15 for each of said toners, and the image will be transferred one after the other on the sheet of paper wound around said transfer drum 11. Therefore, according to the photosensitive drum 15, electrification, exposure, development, and transfer is repeatedly performed for each color, thereby forming an image having the desired color on the paper.

Accordingly, when forming a colored image on the sheet of paper, a toner image is transferred to the sheet paper adsorbed electrostaticly to the transfer drum 11, one color at a time for each one rotation of the transfer drum 11, thereby gaining a colored image with each color on top of the other, by a maximum of four rotations.

Further, the photosensitive drum 15 and the transfer drum 11 are pressed to each other so that a pressure of approximately 8 kg is added to the transfer position, especially in the contacting portion, from the point of view of transfer efficiency and image quality.

The toner image formed on the sheet paper by the above-mentioned method is unfixed, and in order to finish the image as a permanent image, a fixing device 4 for performing heat-fixing according to the present invention is positioned corresponding to the mounting position of the removing pawl 14 of the transfer drum 11.

This fixing device 4 which will be explained in detail hereinafter comprises a heat roll 41 for fixing the toner image formed on the sheet of paper by a predetermined temperature and pressure, and a fixing guide for guiding the sheet removed from the transfer drum 11 by the removing pawl 14 to the heat roll 41.

On the exit of the sheet of said fixing device 4, in other words, the lower stream side of the sheet conveyance, a discharge roll 23 is mounted, and the sheet after the fixture is discharged to a discharge tray 24 mounted on the exterior of the image forming device body. As shown in the drawing, the discharge tray 24 is positioned on the upper portion of the image forming device, and mounted in a slant state.

A discharge passage 25 is further equipped between the discharge exit on the side of the fixing device 4 to the discharge roll 23, in order to guide the sheet of paper being discharged from the fixing device 4 to the discharge roll 23. In the middle of the discharge passage is provided a detection sensor 26 for detecting the sheet of paper being sent out from the fixing device 4. Simultaneously as detecting the discharge of said sheet of paper, the jam detection in the fixing device is performed.

That is, from the time the detection sensor 26 senses the top end of the sheet of paper, the jam detection is performed in correspondence to the time the bottom end of the paper passes, according to each of the paper size.

The detail of the fixing device 4 according to the present invention will now be explained in detail with reference to FIGS. 2A and 2B. The fixing device includes a heat roll 41 comprising on the surface of a cored bar 31 having a cylindrical shape formed of aluminum Al a rubber covering layer 32 having an advantageous release ability against toner, such as silicon rubber, bonded and fixed thereto by an adhesive called a primer or the like. In the interior of the cored bar 31 of the heat roll 41 is mounted a heater lamp 43 formed of a heating source such as a halogen lamp for maintaining the surface temperature of the heat roll to a fixable temperature (set temperature).

On the heat roll 41 is formed a considerable amount of contact width (nip width) for fixing the toner image on the sheet of paper P efficiently between the heat roll 41, and in order to contact the sheet P to the heat roll 41 side, a pressurization roll 42 is mounted, which is formed by covering a cored bar 33 supported rotatably with a silicon rubber or a sponge which is either or both thick and/or with low hardness covered by a PFA tube 34. This pressurization roll 42 improves the adiabatic performance by mounting said thick cover layer 34, and is also considered to reduce the temperature reduction of the heat roll 41 surface on the image side, and forming a large nip width in the conveyance direction contacting said heat roll 41.

On the other hand, power supply to the heater lamp 43 is controlled so as to maintain the surface temperature of said heat roll 41 to a predetermined set temperature. In order to do so, a heat detection sensor 44 formed of a thermistor and the like is mounted to a position contacting the surface of the heat roll 41. Corresponding to the output from the heat detection sensor 44, the control of power supply to the heater lamp 43 is performed.

On the heat roll 41 is further mounted a device 45 for applying an offset preventing liquid (oil) having a good release property such as silicon oil and the like for preventing the adhesion of toner to the heat roll 41 when contacting the toner image held by the paper which works as an image holding body. Further, a cleaning roll 46 is mounted rotatably so as to contact the heat roll 41 surface in order to remove the toner adhered to the roll 41 surface.

As explained in FIG. 1, the application device 45 comprises an application roll 45*a*, an oil tank 45*b* for storing oil, a supply felt 45*c* for supplying oil, and a blade 45*d* for making even the oil on the surface of the application roll 45*a*. The one end of the supply felt 45*c* is submerged to the oil in the oil tank 45*b*, drawing up the oil by the capillary phenomenon, and supplies oil by the other end pressed against the application roll 45*a*.

The tip region of the supply felt 45*c* is pressed against the application roll 45*a* by a spring 48 and a pressing member 47. The excessive oil supplied by the supply felt 45*c* is returned to the oil tank 45*b* by a recovery felt 49.

By the above structure, the oil is supplied and applied by the supply felt 46 to the application roll 45*a*, and the excessive oil supplied to the application roll 45*a* is wiped off by the blade 45*d*. Thereby, a uniform oil layer will be formed to the application roll 45*a* surface, and by the rotation of the application roll 45*a*, oil will be applied to the heat roll 41. As a result, oil preventing offset is applied in a uniform state to the heat roll 41.

The adhesion of toner to the heat roll 41 is restrained by the application of oil. However, the toner adhesion could not be prevented completely. Therefore, the cleaning roll 46 for cleaning the adhered toner is rotatably mounted. The cleaning roll 46 is formed of a non-woven fabric and the like. In order to improve the cleaning performance, it is driven so as to rotate in the opposite direction as the rotating direction of the heat roll 41, especially in the contacting area. Further, when it is formed to rotate in the same direction, the peripheral velocity of the cleaning roll 46 should be set to differ from the peripheral velocity of the heat roll 41.

When an image is formed by a predetermined toner to the sheet P at the image forming portion 3 by the above structure, the paper is separated from the transfer drum 11 and guided to the fixing device 4 as shown in FIGS. 2A and 2B by way of a guide not shown. When conveying the paper holding the image between the heat roll 41 and the pressurization roll 42, the toner is melted by the heat of the heat roll 41, and the toner is fixed to the paper by the compression force. The paper being completed of the fixing process is discharged onto the discharge tray 24 by way of the discharge passage 25 by the discharging operation of the discharge roll 23.

First Embodiment of the Present Invention

Next, the structure for fixing and releasing to a predetermined position the fixing device 4 according to the present invention against the image forming device body so as to enable removal therefrom is explained.

In order to form the fixing device 4 as a unit, and removably mount the unit to the image forming device body, the heat roll 41, the pressurization roll 42, the oil application device 45, the cleaning roll 46 and the like are stored and mounted inside a casing 35.

On the casing 35 is formed an opening 35*a* for introducing paper between the heat roll 41 and the pressurization roll 42, and a discharge exit 35*b* for sending out the paper to the discharge passage 25 after the fixing process. Further, on the end portion of the casing 35, that is, the both end portions on the direction of the rotational axis of the heat roll 41 and the like, are formed a concave portion as shown in FIG. 4, specifically, a handle 35*c* for lifting up the fixing device 4.

Further, as shown in FIG. 3, the two rolls 41 and 42 are supported rotatably by a frame 36 formed on both sides of the casing through bearings 37, 38. The frame 36 form one portion of the casing 35. The bearing 37 formed on the frame 36 is fixed to position. However, the bearing 38 for rotatably supporting the pressurization roll 42 is movably mounted to a long hole formed on the frame 37 so as to enable movement to the heat roll 41 direction.

The pressurization roll 42 is formed to be pressurized toward the heat roll 41 by a predetermined pressure. Therefore, a pressurization lever 50 for forcing the bearing 38 rotatably supporting the pressurization roll 42 is mounted so as to contact thereto. The pressurization lever 50 is mounted at one end to the frame 36 by a step screw 51, supported so as to rotate with the step screw 51 positioned at the center of rotation. On the other end of the pressurization lever 50 from the supporting portion is mounted one end of a spring 52. Since the other end of the spring 52 is mounted to a mounting portion 36*a* on the frame 36, the pressurization roll 42 is pressurized toward the heat roll 41 side by the force of the spring 52.

On the other hand, in order to release the pressurized state of the heat roll 41 by the pressurization roll 42, a release lever 53 is mounted rotatably to the frame 36. On the release lever 53 is formed integrally a cam 53*a* for releasing the pressurized state by the pressurization lever 50, and a connecting pin 53*b* linked to a fixing lever 54 for fixing the unit of the fixing device 4 to the predetermined position on the image forming device. The cam 53*a* is formed so as to place an axis 53*c* enabling rotation of the release lever 53 against the frame 36 at the center thereof, which is rotated in correspondence to the rotation of the axis 53*c*. The cam 53*a* is positioned so as to contact a partial folding piece (cam follower) 50*a* on the pressurization lever 50 by the force from the spring 52.

Moreover, the fixing lever 54 is supported rotatably to a boss 36*b* mounted integrally to the frame 36 through a screw 55. On the boss 36*b* is mounted a spring 56 for forcing the fixing lever 54 to the anti-clockwise direction in the drawing constantly, wherein one end of the spring 56 is mounted to a mounting portion 36*c* of the frame 36, and the other end is mounted to a mounting portion 54*a* of the fixing lever 54. Accordingly, the spring 56 provides a force in the widening direction, and forces the fixing lever 54 in the anti-clockwise direction of the drawing constantly.

On the fixing lever 54 is formed a long hole 54*b* having an arc shape where the connecting pin 53*b* of the release lever 53 is penetrated. Therefore, with linkage to the rotational movement of the release lever 53, the fixing lever 54 will also be rotated. On the fixing lever 54 is further formed a fixing piece 54*c* for fixing the fixing device 4 unit to the fixing device mounting stage 57 on the image forming device body. In correspondence to the fixing piece 54*c*, a fixing slit 57*b* is formed on a folding piece 57*a* on the mounting stage 57 of the fixing device 4 in the image forming device body. The fixing piece 54*c* of the fixing lever 54 is fit to the fixing slit 57*a*, thereby fixing and maintaining the fixing device 4 on the mounting stage 57.

Therefore, in FIG. 2A, when the release lever 53 is in position, then by the force of the spring 52, the minor axis portion of the cam 53*a* mounted integrally to the release lever 53 is contacted to the folding piece 50*a* of the pressurization lever 50. At this time, by the force of the spring 52, the linked fixing lever 54 is forced in the anti-clockwise rotating direction in the drawing through the connecting pin 53*b*. Further, the fixing lever 54 is rotated in the anti-clockwise direction by the force of the spring 56. Then, the fixing piece 54*c* of the fixing lever 54 is fit to the fixing slit 57*b* of the mounting stage 57, and the fixing device 4 unit is fixed to the mounting stage 57.

Further, on the mounting stage 57 is formed a means for positioning the fixing device 4. The positioning of the fixing device 4 is realized, as shown in FIG. 4, by forming a positioning hole 35*d* on the casing 35 in the fixing device 4 side in correspondence to the positioning pin 57*c* mounted at least to two places on the mounting stage 57. Positioning is performed by inserting the positioning pin 57*d* on the mounting stage 57 through the positioning hole 35*d* of the fixing device 4, and thereby mounting the fixing device 4 to the mounting stage 57.

Figure 5:
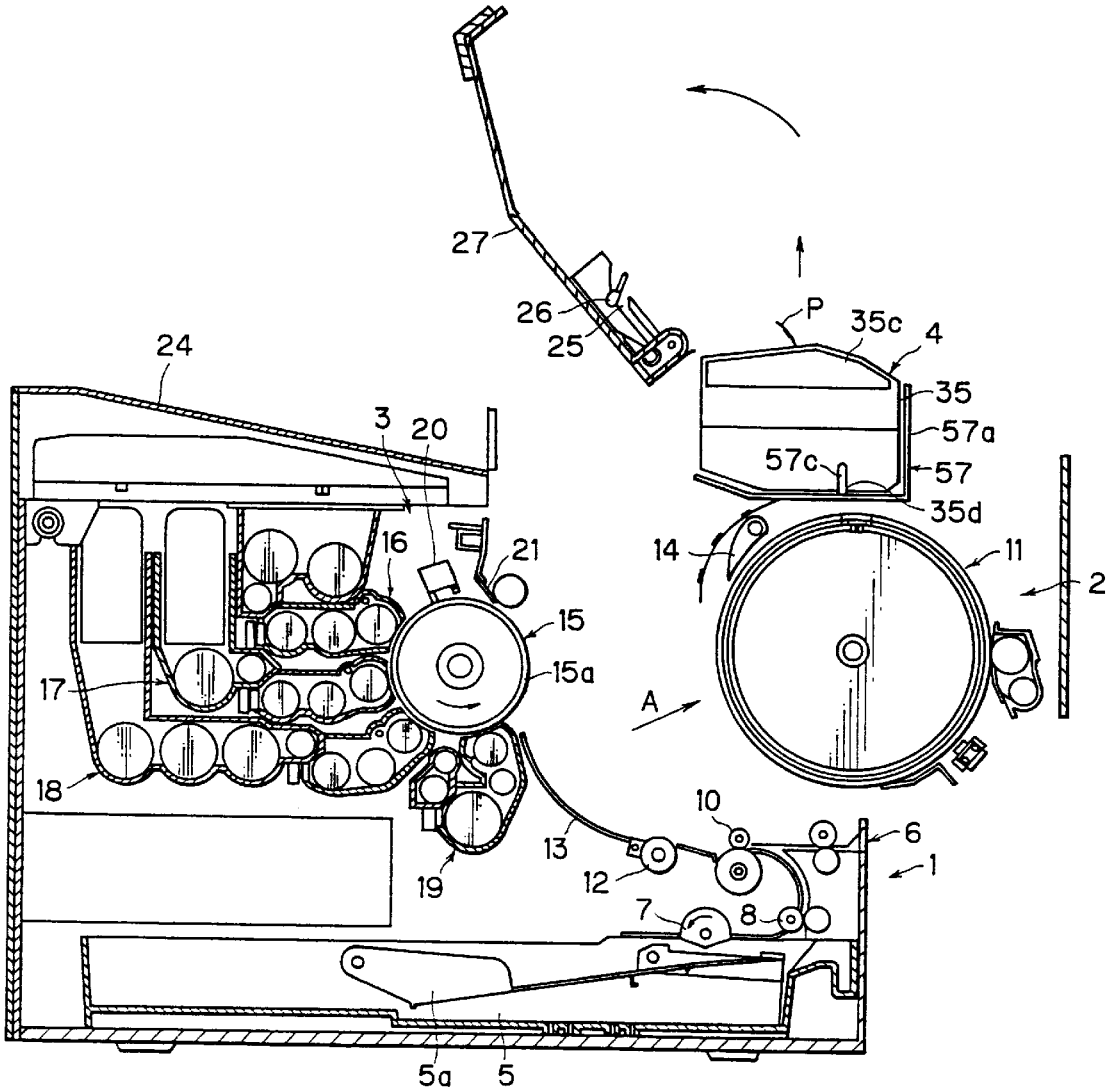
FIG. 5 is a drawing showing one example of the structure for taking out the fixing device of the present invention from the image forming device of FIG. 5.

Further, the image forming device body is formed so that the exterior of the image forming device corresponding to the fixing device 4 could be opened so as to remove a jammed paper in case the sheet of paper is jammed in the position of the fixing device 4. That is, as shown in FIG. 5, the guide forming the discharge passage 25 formed in correspondence to the discharge exit 35*b* of the fixing device 4, and the exterior 27 mounting the supporting member for supporting the discharge roll 23 are formed so as to release the fixing device 4 by rotating for example with the rotary axis of the discharge roll 23 as the center of rotation.

The transfer drum 11, the fixing device 4 and the exterior 27 for opening the fixing device 4 is supported by the same supporting body including the mounting stage 57, and mounted enabling simultaneous pull-out to the upper right direction of FIGS. 3 and 4. Accordingly, as shown in FIG. 5, the fixing device 4 and the transfer drum 11 are mounted so as to enable simultaneous pull-out in the arrow A direction.

In the above structure, when the sheet of paper P is jammed, it is detected by a detection sensor 26. In response to the detection, the power supply to the heater lamp 42 on the heat roll 41 side of the fixing device 4 is shut off. Then, in order to remove the sheet of paper being jammed inside the fixing device 4, as shown in FIG. 5, the whole unit comprising the transfer drum including the fixing device 4 is pulled out, and the exterior 27 covering the upper portion of the fixing device 4 is opened.

Then, in order to remove the jammed paper P, the fixing device 4 is taken out in the upper direction. Therefore, the release lever 53 is rotated to the arrow direction as shown in FIG. 2A. Thereby, the major axis portion of the cam 53*a* gradually contacts the folding piece 50*a* of the pressurization lever 50, rotating the pressurization lever 50 to the same direction in FIGS. 2A and 2B. Thereby, the fixing lever 54 is moved in the clockwise direction against the force of the spring 56 with linkage to the rotation of the connecting pin 53*b*. Therefore, the fixing piece 54*c* is dislocated from the fixing slit 57*b* on the mounting stage 57, and the fixing state to the mounting stage 57 of the fixing device 4 is also simultaneously released.

In other words, simultaneously as releasing the pressurized state of the pressurizing roll 42 and the heat roll 41 of the fixing device by one operation, the fixed state of the fixing device 4 will be released. At this time, by the rotary operation of the release lever 53, in order to maintain the state where the major axis portion of the cam 53*a* is contacted to the folding piece 50*a* of the pressurization lever 50, the surface of the cam 54*a* is formed to have a flat surface. Thereby, the pressurization released state could be maintained.

Therefore, simultaneously as saving the conventional trouble of performing the fixture release, the fixed state of the fixing device 4 could also be released in correspondence to the pressurization release operation, so the fixing device 4 could be taken out at such state to the upper direction from the mounting stage 57. Thereby, the jammed paper P could easily be removed. As a result, the operability, the serviceability and the like could be improved.

Especially, since the fixed state is released simultaneously, the fixing device 4 is carried up in the upper direction in order to remove the jammed paper P. In such case, the fixing device 4 is carried by placing the hands to the concave portions 35*c* formed on the both end portions in the rotational axis direction of the casing 35 mounting the fixing device 4 as a unit. Further, the jammed paper P is held between the rolls 41 and 42 having been released of pressure, and simultaneously with the carrying up of the fixing device 4, it will be removed from the interior of the image forming device.

Then, after removing the jammed paper P, the fixing device 4 is mounted onto the mounting stage 57 which has been pulled out. At this time, positioning is performed by inserting the positioning pin 57*c* to the positioning hole 35*d* on the fixing device 4 side. Thereafter, the release lever is rotated from the state shown in FIG. 2B to a clockwise direction. In response to this operation, the minor axis portion of the cam surface in the cam 53*a* gradually come to contact with the folding piece 50*a* of the pressurization lever 50, and by the act of the spring 52, the pressurization roll 42 will be pressed toward the heat roll 41.

Further, by the action of the spring 56, the fixing lever 54 will simultaneously be rotated toward the anti-clockwise direction. Finally, when it reaches the state shown in FIG. 2A, the fixing piece 54*c* of the fixing lever 54 will be inserted to the fixing slit 57*b* of the mounting stage 57 and fixed thereto. The fixed state will not be disconnected, since the spring forces the fixing lever 54 toward the anti-clockwise direction constantly.

When the fixing of the fixing device 4 and the pressurization between the pressurization roll 42 and the heat roll 41 are completed by one operation, the exterior 27 covering the upper portion of the fixing device 4 will be closed, and the transfer roll 11 including the fixing device 4 is inserted toward the left direction of FIG. 5 to the position shown in FIG. 4. Thereby, the image forming device is set as shown in FIG. 4 in an operable state. Then, the power supply to the fixing device 4 will be resumed, and when the device reaches a fixable temperature, it is in a ready state.

As was explained above, simultaneously as releasing the pressurization of the fixing device 4 being removed, the fixed state of the fixing device 4 will be released. Therefore, the fixing device 4 could be taken out of the image forming device by a very easy operation, and it also could be fixed to the predetermined position very easily. The operability and the serviceability could be improved and the removal of the jammed paper is simplified.

Further, if the jammed paper must be removed, the pressurization is released when the fixing device 4 is taken out of the image forming device, so the paper could easily be removed, and the problem of the prior art methods could be solved.

Second Embodiment of the Present Invention

As was explained above, when taking out the fixing device 4 from the image forming device body and removing the jammed paper, according to the present invention, the jammed paper will not be pulled out from the discharge exit 35*b* side toward the conveyance direction.

That is, the jammed paper P will be pulled out to the opposite direction of the conveyance direction of the paper from the opening 35*a* side of the fixing device 4. In order to do so, the present invention is equipped with a limiting means for locking the pulling out of the paper P to the conveyance direction by the heat roll 41 or the pressurization roll 42.

One example of the limiting means is disclosed. The heat roll 41 driven to rotate by the rotational force being transmitted from the motor or drive source is formed so as to be driven by way of a one-way clutch. That is, the one-way clutch transmits the rotational force from the motor to the heat roll only in one direction, and it is mounted to the heat roll 41 so as to transmit the drive force to the conveyance direction of paper P. Thereby, when the drive force is transmitted, the rotation is transmitted and the heat roll 41 is driven to the direction conveying the paper P toward the discharge exit. However, when the jammed paper is rotated to the discharge exit direction, the roll is locked by the act of the one-way clutch, and the jammed paper could not be pulled out.

In contrast, when the paper P is pulled out to the opposite direction to the conveyance direction of the paper from the opening 35*a* or the side where the paper P is guided from, the heat roll 41 would be easily rotated by the operation of the one-way clutch, and the jammed paper P could easily be removed. In stead, the one-way clutch could be mounted on the pressurization roll 42 side, which also enables to easily pull out the paper P from the opening 35*a* side.

As above, the jammed paper P could not be pulled out in the conveyance direction, but could be pulled out to the opposite direction to the conveyance direction. Therefore, the unfixed toner image left on the paper P will not be heat treated by the heat roll 41, but instead, the fixed toner image contacts the heat roll 41 again. Therefore, the toner will not be adhered to the heat roll 41. Further, the load of cleaning the heat roll 41 due to toner adherence will be reduced, and could be corresponded to by methods other than web methods, for example, by a cleaning pad having a simple structure, that is, a rotary driven cleaning roll 46 and the like.

Further, since the unfixed toner will not contact the heat roll 41, the toner dispersion and the like could be avoided, and the problem of uneven application by the oil application device could also be solved.

Third Embodiment of the Present Invention

According to the above-mentioned first embodiment, the fixing device 4 could easily be removed and fixed to the image forming device, and the jam management could be carried out easily. A further embodiment will be explained below where the jammed paper is held securely between the two rolls, and at the same time, could be removed from the image forming device when removing the fixing device 4 from the image forming device body.

Figure 6:
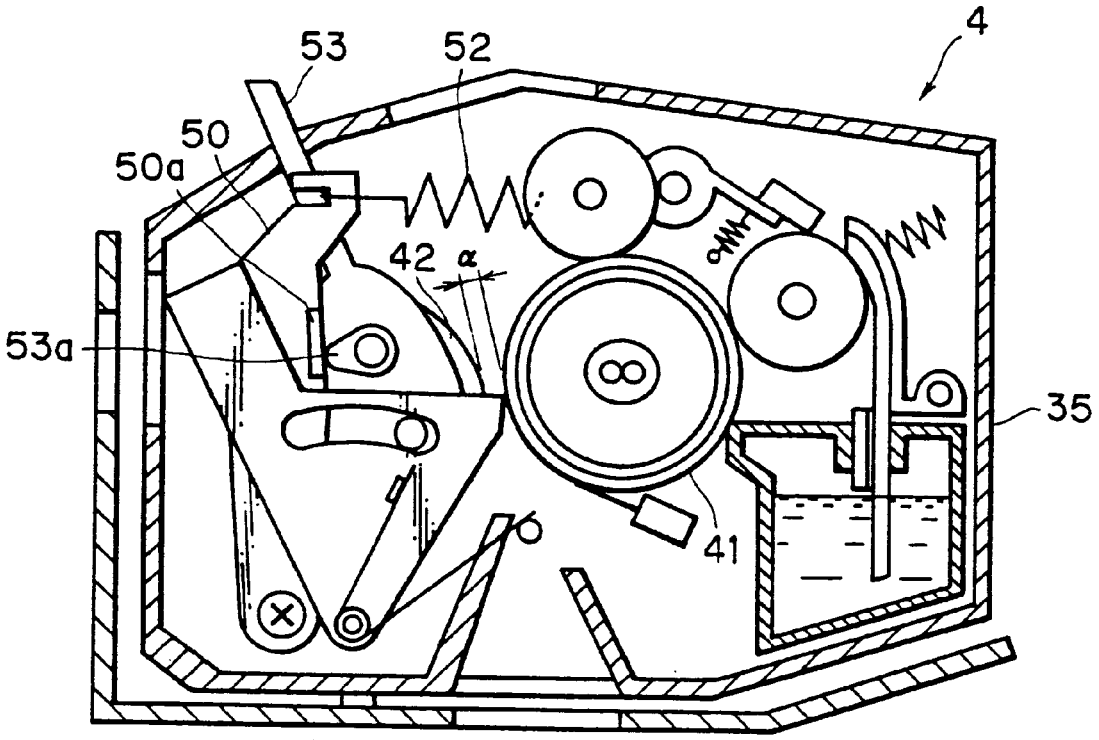
FIG. 6 is a drawing showing the pressure released state of the fixing device for explaining the third embodiment of the present invention.

As shown in FIG. 6, a gap $\alpha$ of the contact area between the pressurization roll 42 having been released of pressure and the heat roll 41 is set to a value where the jammed paper P could be held sufficiently therebetween, and would not fall when the fixing device 4 is pulled up.

That is, even when the heat roll 41 and the pressurization roll 42 are heated, and the roll diameter is in a thermally expanded state by approximately 0.2–0.7 mm, the gap $\alpha$ is set to approximately –0.5 mm. In other words, when the pressurization roll 42 is light weighed and in a state being pressed by the heat roll 41, the heat roll 41 is set to intrude (overlap) for approximately 0.5 mm to the pressurization 42 by the elastic deforming characters thereof. Therefore, the jammed paper could sufficiently be held between the two rolls 41 and 42, and will not fall when taking out the fixing device 4.

The pressurization roll 42 is pressurized so that the contact portion between the heat roll 41 intrudes thereto in an arc state when being pressed to the heat roll 41 by the pressurization lever 50, as shown in FIG. 2A. This is because the cover layer of the pressurization roll 42 is more flexible or the layer thickness is larger than the cover layer of the heat roll 41. Further, even when the pressure is released, the contact state between the two rolls 41, 42 are not released, but rather, they are pressed together to some extent.

Such setting could be performed by appropriately adjusting the state of the major axis portion of the cam surface of the cam 53*a* in the release lever 53 being contacted to the folding piece 50*a* of the pressurization lever 50. For example, it could be performed for instance by adjusting the bent angle of the folding piece 50*a* of the pressurization lever, or the length of the major axis portion of the cam 53*a*.

Thereby, in response to taking out the fixing device 4, the jammed paper P could be held between the two rolls 41 and 42, and removed simultaneously without falling into the image forming device.

Therefore, when taking out the fixing device 4 from the image forming device body in order to remove the jammed paper P, dispersion of the unfixed toner left on the paper P could be prevented, and the interior of the image forming device would not be contaminated. Moreover, the oil application device 45 on the fixing device 4 side would no longer be contaminated by dispersing toner which causes problems such as uneven application.

According to the image forming device comprising the fixing device of the present invention, when removing the fixing device from the image forming device, the fixed state is released simultaneously as when the pressurization between the rolls is released, and thereby, the fixing device could easily be taken out. Therefore, the operability and the serviceability of the device increases, and at the same time, the jammed paper could easily be removed therefrom.

Moreover, when removing the jammed paper, it is set to be pulled out to the opposite direction of the conveyance direction of the paper rather than to the same direction, thereby preventing the unfixed toner from adhering to the heat roll and the like, reducing greatly the load of cleaning, simplifying the structure of the cleaning means, miniaturizing the fixing device, reducing the cost of the device, and even enabling miniaturization of the whole image forming device.

Further, when taking out the fixing device, the pressure between the two rolls is released to a state where the paper could be held between the rolls without falling. Therefore, the problem of contamination of the interior of the image forming device body by the dispersion of unfixed toner caused by the jammed paper falling thereto could be prevented.

We claim:

1. An image forming device equipped with a fixing device positioned in a conveyance passage of an image holding body holding an unfixed image; said fixing device comprising a heat roll whose surface is heated to a desired temperature for heat-fixing said unfixed image; and a pressurization roll for contacting said image holding body pressurized and conveyed by said heat roll to the heat roll side; wherein a fixing member for fixing said fixing device to a predetermined position in said conveyance passage is provided, and the fixture release by said fixing member is performed in linkage to the operation for the pressurization release between said heat roll and said pressurization roll.

2. An image forming device equipped with a fixing device according to claim 1, wherein said pressurization release is realized by a rotating release lever, a member equipped on said release lever for rotating said release lever to a release direction against the pressurization lever for pressurizing the pressurization roll to the heat roll side, and a connecting member for rotating in linkage thereto a fixing lever to the fixture release direction which is constantly forced to the fixing direction for fixing said fixing device to a predetermined position, wherein the pressurization release and the fixture release could be performed simultaneously.

3. An image forming device equipped with a fixing device according to claim 1 or claim 2, wherein during the fixture released state of said fixing device, when taking out said fixing device, the pressurization release is performed in a state such that said image holding body is held between the two rolls, and at the same time, said image holding body could be removed therefrom.

4. An image forming device equipped with a fixing device positioned in a conveyance passage of an image holding body holding an unfixed image; said fixing device comprising a heat roll whose surface is heated to a desired temperature for heat-fixing said unfixed image; and a pressurization roll for contacting said image holding body pressurized and conveyed by said heat roll to the heat roll side; wherein a fixing member for fixing said fixing device to a predetermined position in said conveyance passage is provided, and by performing a fixture release by said fixing member, said fixing device is mounted to said predetermined position enabling removal therefrom, and further comprising a limiting means for disabling the pulling out of said image holding body to the same direction as the conveyance direction of said image holding body, but rather, enabling the pulling out of said image holding body to the opposite direction after said fixing device is removed.

5. An image forming device equipped with a fixing device according to claim 4, wherein said limiting means comprises a one-way clutch enabling transmission of a drive force to said heat roll or said pressurization roll in the conveyance direction of said image holding body, and freeing a drive toward the other direction, in order to disable the pull out of said image holding body to the conveyance direction and to enable the pull out to the opposite direction.

* * * * *